United States Patent [19]

Wetzler et al.

[11] 4,019,457

[45] Apr. 26, 1977

[54] APPARATUS FOR APPLYING HOT-MELT GLUE TO EDGE OF SHEET STACK

[75] Inventors: Josef Wetzler, Rosenheim-Schlossberg; August Gaschler, Rosenheim; Heinz Hofmann, Oberwohr near Rosenheim, all of Germany

[73] Assignee: Planatolwerk Willy Hesselmann, Thansau, Germany

[22] Filed: July 2, 1975

[21] Appl. No.: 592,672

[30] Foreign Application Priority Data

July 4, 1974 Germany ..... 2432540

[52] U.S. Cl. ..... 118/35; 118/202; 118/238; 118/244

[51] Int. Cl.[2] ..... B05C 1/02

[58] Field of Search ..... 118/238, 35, 244, DIG. 9, 118/202; 11/1 AD; 269/236; 156/578, 477 B

[56] References Cited

UNITED STATES PATENTS

| | | | |
|---|---|---|---|
| 528,968 | 11/1894 | Peabody | 269/236 X |
| 3,376,850 | 4/1968 | Pierce, Jr. | 118/202 |
| 3,594,837 | 7/1971 | French | 11/1 AD |
| 3,863,596 | 2/1975 | Anderson | 118/238 X |

FOREIGN PATENTS OR APPLICATIONS

| | | | |
|---|---|---|---|
| 1,205,437 | 4/1959 | France | 11/1 AD |
| 2,714 | 1915 | United Kingdom | 118/238 |
| 1,258,746 | 12/1971 | United Kingdom | 11/1 AD |

*Primary Examiner*—John P. McIntosh
*Attorney, Agent, or Firm*—Karl F. Ross; Herbert Dubno

[57] ABSTRACT

A stack of sheets is stood on a support surface inclined to the horizontal by 15° at the upstream end of a track. A pair of elements perpendicular to this surface and mounted on a carriage clamp this stack and the carriage is displaced to the opposite end of the track. An applicator brush underneath the track in its center is rotated about an axis perpendicular to the track and parallel to the support surface. This brush is partially immersed in a hot-glue bath so that on rotation it may stroke a layer of glue on the bottom of the stack held in the clamp on the carriage.

10 Claims, 6 Drawing Figures

Fig. 1
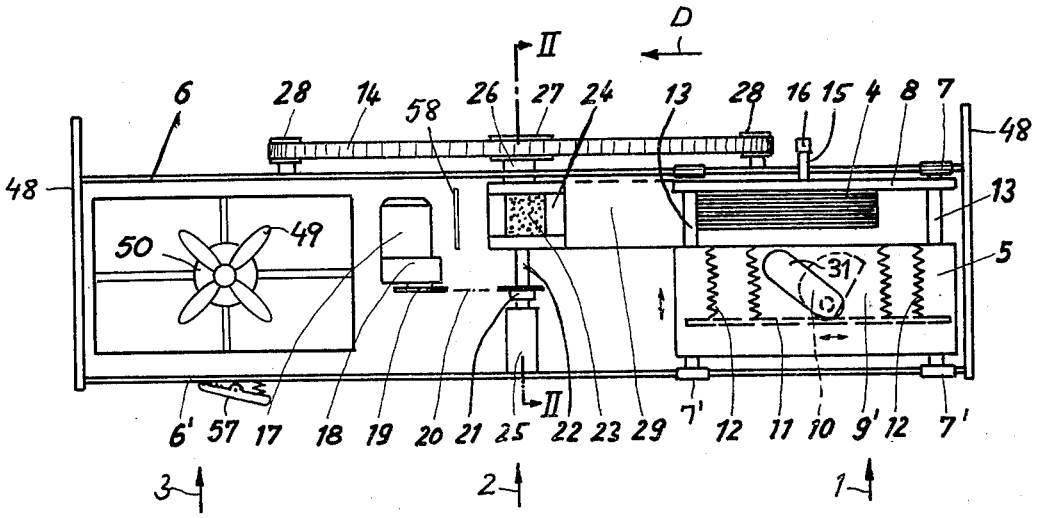
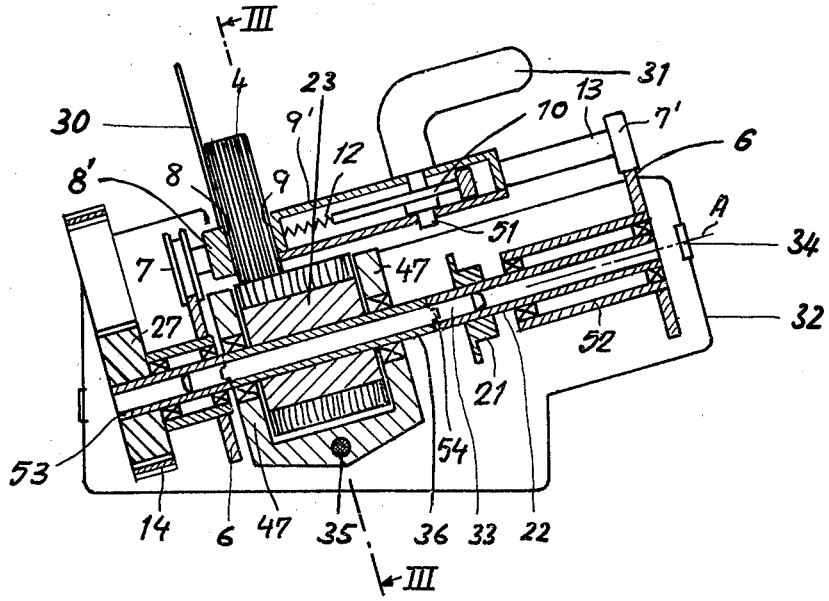
Fig. 2

APPARATUS FOR APPLYING HOT-MELT GLUE TO EDGE OF SHEET STACK

CROSS REFERENCE TO RELATED APPLICATION

This application is related to commonly assigned and copending patent application Ser. No. 437,886 filed 30 Jan. 1974 (now U.S. Pat. No. 3,926,712).

FIELD OF THE INVENTION

The present invention relates to a bookbinding apparatus. More particularly this invention concerns an apparatus for applying an adhesive to the edge of a stack of sheets in a bookbinding operation.

BACKGROUND OF THE INVENTION

In the stitchless binding of a book it is necessary to apply to the edge of the stack of leaves or pages an adhesive so as to saturate the very edge of every page and form a sturdy back to which a cover sheet is applied. It is essential that every sheet have its back edge anchored in the layer of glue or adhesive applied to the back of the stack; if any one sheet is not anchored and falls out the book is unsalable.

Such an operation is usually carried out in a three-part machine having an assembly station, a gluing station downstream therefrom, and a drying or setting station. A carriage adapted to clamp the stack of sheets is displaceable between these stations. In use the bookbinder fits a stack of sheets into the carriage at the assembly station and then displaces it over a glue-coated roller at the gluing station and allows the freshly glued stack to sit in the drying station. A hot-melt adhesive is particularly useful in this type of arrangement so that the drying station need merely be equipped with a blower or the like to set and harden the adhesive by cooling it.

The principal problem with such a system is forming a stack wherein the back edges of all of the sheets are coplanar. In the prior art systems the upper surface of the carriage is perfectly horizontal and the one clamping element or plate against which the stack is pressed by the other clamping element is perfectly vertical. Thus the stack must be carefully arranged on this surface and then clamped in place. When a relatively thick stack of sheets is to be so positioned it is difficult to do this neatly. Furthermore in an arrangement wherein several such stacks must be placed, one after the other, in the clamp it is very difficult to achieve an adequately exact alignment of the back edges of the leaves.

Unless the leaves or sheets are perfectly aligned the conventional roller is unable to apply the needed uniform layer of glue to the stack edge. Any edge not absolutely in line with the edges of adjoining sheets would therefore not be appropriately coated. For these and other reasons the bookbinder using the apparatus must take particular care to tamp down and exactly align the leaves of each stack being glued.

OBJECTS OF THE INVENTION

It is therefore an object of the present invention to provide an improved bookbinding apparatus.

Another object is the provision of an improved apparatus for applying a hot-melt adhesive to the edge of a stack of leaves in a bookbinding operation.

Yet another object is to provide such an apparatus which allows the sheets to be aligned with precision, yet wherein the glue will coat edges of slightly misaligned leaves.

SUMMARY OF THE INVENTION

These objects are achieved according to the present invention by providing a carriage having a planar upper support surface which supports the stack edgewise and which is inclined at an angle of at least 8° to the horizontal, preferably between 8° and 22°. At least one lateral support element in the form of a plate perpendicular to this upper support surface is provided on the carriage also, and another perpendicular clamping element may be provided to press the stack against this perpendicular plate.

According to another feature of this invention the glue-applying element is a brush of a generally cylindrical shape and rotatable about an axis parallel to the upper surface of the table and perpendicular to the direction of displacement of the carriage from the assembly station through the gluing station to the setting station. The bottom of the stack is swept by the carriage across the top of the glue-applying brush whose bottom portion is immersed in a heated glue bath.

With the system according to the present invention it is therefore possible to form a self-standing stack on the carriage. The slight inclination of the upper surface of this carriage prevents the stack of leaves from falling over so that the assembler may completely release it to place several stacks of such leaves adjacent one another in order to form a very thick volume. Since the two faces of a stack need not be clamped together in order to hold the stack upright, little force prevents the sheets from slipping down flat against the upper surface of the carriage. After the stack is fully assembled a clamp is actuated against opposite faces of the stack and the carriage is displaced across the similarly tipped brush. The bristles of the brush stroke and carefully coat the underside of the stack, even getting into the grooves formed by a sheet which has not quite slipped down flush with the level of the other sheets of the stack. Indeed with such an arrangement it is possible to glue together the edges of sheets not trimmed to uniform size, such as computer printouts.

In accordance with yet another feature of this invention the applicator brush is journaled in a massive metallic, here aluminum, reservoir that is provided with a heater to maintain the glue molten. The drive shaft for this brush protrudes slightly from each side of the reservoir. This shaft is alignable and releasably connectable with the drive shaft of the unit, so that it can simply be disconnected and the entire glue reservoir and applicator brush removed for replacement with another type brush, or simple servicing.

BRIEF DESCRIPTION OF THE DRAWING

The above and other objects, features and advantages will become more readily apparent from the following, reference being made to the accompanying drawing in which:

FIG. 1 is a top view of the system according to the present invention;

FIGS. 2 and 3 are sections taken along lines II—II of FIG. 1 and III—III of FIG. 2, respectively;

SPECIFIC DESCRIPTION

Figure 3:
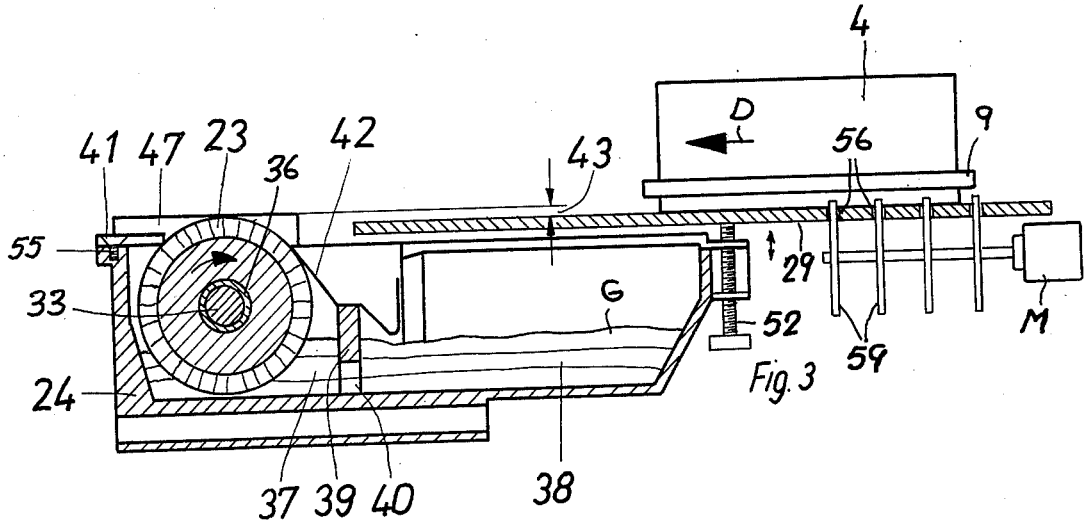

The apparatus according to the present invention as shown in FIGS. 1 and 2 has a housing 32 with a pair of parallel end plates 48 between which extend two parallel rails 6 and 6′ between an upstream assembling station 1, a midway gluing station 2, and a downstream setting station 3. The operator stands to the side of the machine of rail 6′. A clip 53 at the station 3 holds cover sheets.

The carriage 5 is constituted by a pair of parallel rods 13 each extending between one roller 7 and an opposite roller 7′. A clamping bar 8′ is fixed to the rods 13 and a clamping plate 30 parallel to the inside face 8 of the bar 8′ forms a planar continuation thereof that lies at an angle of 75° to the horizontal. In addition the rods 13 and the rails 6 lie at an angle of 15° to the horizontal, perpendicular to the clamping face 8. Slidable on the rods 13 is another clamping element 9′ having an end face 9 torned toward and parallel to the face 8. Springs 12 are engaged between the lip forming the end face 9 and a cross member 11 secured to the rods 13 so as normally to pull this element 9′ back away from the element 8. An eccentric disk 10 is mounted on a pin 51 journaled in the top and bottom of faces of the clamp element 9′. A handle 31 on this mounting pin 51 allows the angular position of the eccentric disk to be varied so as positively to displace the element 9′ toward the element 8 and clamp a stack 4 of sheets between the surfaces 8 and 9. When turned clockwise as seen in FIG. 1 the handle 31 allows the springs 12 to retract the plate 9′, but when turned counterclockwise it securely clamps the stack 4 in place. Underneath the carriage 5 in the assembly station 1 and part of the way to the gluing station 2 is a metal base plate 29 lying at an angle of 15° to the horizontal and vertically displaceable by means of screws 52 (see FIG. 3).

The apparatus is provided with a drive motor 17 having a transmission 18 on which is mounted an output sprocket 19 connected via a chain 20 to a sprocket 21 carried on a hollow main drive shaft 22 journaled at 53 in the housing 32 (see FIG. 2). This shaft 22 is connected as will be described below through a brush drive shaft 36 to another hollow shaft 53 on which is mounted a toothed pulley 27. An internally and externally toothed belt 14 is spanned under the pulley 53 and over two idler pulleys 28 respectively positioned at the assembly station 1 and setting station 3 so as to form a straight stretch of the belt 1 between these two stations.

The carriage 5 is provided with an outrigger arm 15 having at its end gripping means 16 engageable with the upper stretch of the belt 14 so that this belt 14 can displace the carriage 5. The motor 17 is operated continuously so that in use the carriage 5 is merely displaced slightly in the direction D after a stack of sheets has been locked thereon and the coupler 16 will engage with the belt 14 and pull the carriage 5 through the glueing station 2 into the setting station 3.

Figure 4:
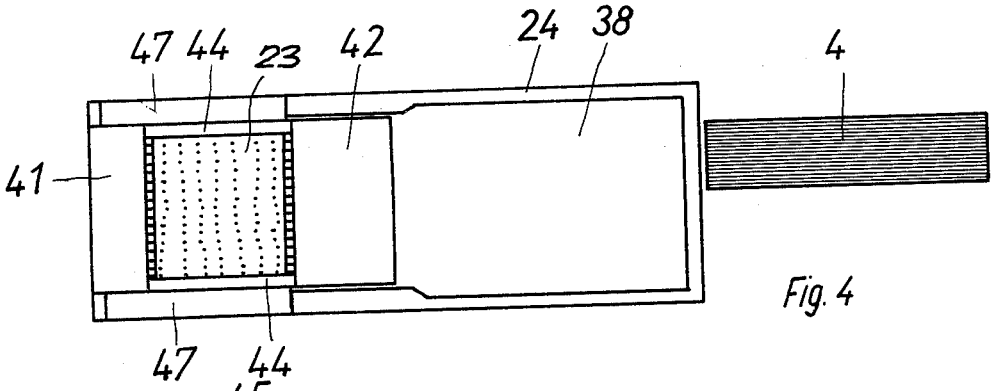
FIG. 4 is a top view of the detail shown in FIG. 3.
Figure 5:
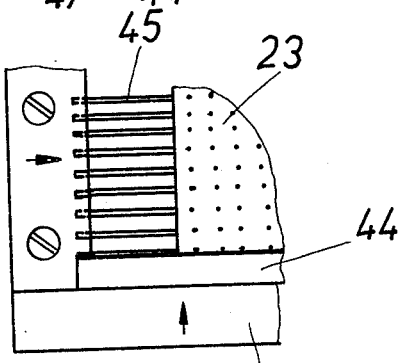
FIG. 5 is a large-scale view of a detail of FIG. 4.

As shown in FIGS. 3 and 4 the glueing station 2 is provided with a brush 23 having bristles 45 and journaled in opposite walls 54 of a tilted glue reservoir 24. This reservoir 24 is formed of heavy aluminum and is provided with a heater 35 (see FIG. 2) to keep the glue G therein molten. In addition this reservoir 24 is subdivided by a partition wall 39 into a compartment 37 receiving the brush 23 and a supply compartment 38 upstream therefrom. The partition wall 39 is formed with a throughgoing hole 40 so that glue from the compartment 38 may flow into the compartment 37. The roller 23 is continuously rotated by the motor 17 in an angular sense such that its bristles at the top move against the direction of displacement D. A metal scraper 41 secured in place by screws 55 so as to be displaceable toward and away from the roller prevents excess glue from being carried upwardly by the roller 23 out of the bath 37, and a sheet metal scraper 42 is provided at the upstream side of the brush 23 so as to clean it after it wipes the bottom of the stack 4. Glue scraped off by the scraper 42 will flow back into the compartment 38. Scrapers 44 are provided in the axial ends of the brush 23 so as to prevent glue buildup here. FIG. 3 also shows how the uppermost portion of the brush 23 lies below the level of the upper surface of the plate 29 by a distance 43. Another scraper 58 between stations 2 and 3 wipes excess adhesive off the stack 4.

As best shown in FIG. 2 the shaft 36 carrying the brush 23 is independent of the shafts 22 and 53 and is formed at its ends with teeth 54 engaging in these shafts 22 and 53. A rod 33 may be slid into either of these shafts 53 or 22 so as to align the shafts 53, 36, and 22 together. This also suspends the reservoir 24 from the drive shaft and insures that the brush 23 will be rotated about its axis A at an angle of 15° to the horizontal. Driving out of the pin 33 by removing the end cover plate 34 allows the reservoir and brush to be removed for cleaning and servicing.

FIG. 1 shows how a fan 49 carried on a motor 50 is mounted at the setting station 3 to cool the thermally setting glue G.

Figure 6:
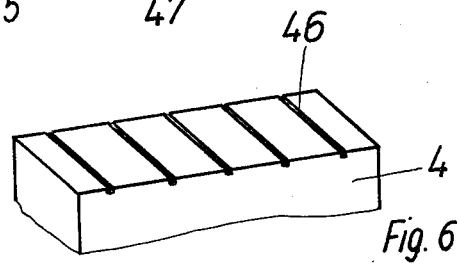
FIG. 6 is a perspective view of the bottom corner of the stack shown in FIGS. 1–3.

In addition saw blades 59 driven by a motor M may engage through slots 56 in the plate 29 as shown in FIG. 3 so as to form grooves 46 (FIG. 6) in the edge of the stack 4. These grooves 46 facilitate bonding of the pages together.

The apparatus according to the present invention functions as follows:

The glue in the reservoir 24 is heated up, and the motors 50 and 17 are set in operation. Then the bookbinder, with the carriage 5 in station 1, rotates the handle 51 clockwise so as to retract the clamping face 9 from the clamping element 8.

One or more stacks 4 of sheets are then positioned on the plate 29 with the stack lying flush against the plate 30. The binder then rotates the handle 31 counterclockwise so as to lock these stacks 4 tightly in place between faces 8 and 9.

The carriage 5 is then manually displaced slightly until the coupler 16 engages the toothed belt 14. The belt 14 then slowly entrains the carriage along in the direction D, causing the brush 23 to wipe a uniform layer of glue onto the bottom edge of the stack 4, with the bristles of the brush deflecting and bending on contact with the stack.

The machine automatically displaces the carriage 5 into the setting station 3 where the blower 49 hardens and sets the glue applied to the edge of the stack 4.

The binder then turns the clamp 31 clockwise so as to release the stack, lays it aside and slides the carriage 5 back to the upstream position to restart the operation. The coupler 16 is so constructed as to couple the carriage 5 to the belt 14, but to allow it to be slid back upstream by the operator when desired.

We claim:

1. A bookbinding apparatus for applying an adhesive to the edge of a stack of sheets, said apparatus comprising:

a generally straight horizontal track having an upstream end and a downstream end;

a support surface at said upstream end and inclined at an angle of more than 8° to the horizontal;

a carriage inclined at said angle to the horizontal displaceable along said track above said surface and between said ends;

a pair of clamping elements on said carriage parallel to each other and perpendicular to said surface;

means on said carriage for displacing one of said elements toward the other element for clamping a stack of sheets therebetween with the edge of said stack lying on said surface when said carriage is at said upstream end;

a generally cylindrical applicator between said ends and rotatable about an axis substantially parallel to said surface and transverse to said track, whereby displacement of said carriage between said ends with a stack clamped between said elements will wipe said edge over said applicator; and means including an adhesive reservoir tilted at said angle to the horizontal for applying adhesive to said applicator.

2. The apparatus defined in claim 1, further comprising means for displacing said carriage between said ends.

3. The apparatus defined in claim 2, further comprising a drive motor connected to said means for displacing and connected to said applicator for rotating same.

4. The apparatus defined in claim 1 wherein said applicator is a brush.

5. The apparatus defined in claim 4 wherein said brush is partially immersed in said reservoir.

6. The apparatus defined in claim 5 further comprising means for heating said reservoir and melting said adhesive.

7. The apparatus defined in claim 5 wherein said reservoir is provided with a partition subdividing same into an upstream storage compartment and a downstream compartment receiving said brush, said partition being formed with an aperture for fluid communication between said compartments.

8. The apparatus defined in claim 1, further comprising means for transversely grooving said edge of said stack after clamping same in said carriage.

9. The apparatus defined in claim 1 wherein said track is a pair of parallel rails and said carriage is provided with rollers riding on said rails.

10. The apparatus defined in claim 1 wherein said carriage is provided with at least one spring normally pulling one of said elements away from the other and with an eccentric engageable with said one element to displace same toward the other on rotation of said eccentric.

* * * * *